US010995524B2

(12) United States Patent
Bishop et al.

(10) Patent No.: US 10,995,524 B2
(45) Date of Patent: May 4, 2021

(54) MOTOR VEHICLE DOOR LATCH

(71) Applicant: Kiekert AG, Heiligenhaus (DE)

(72) Inventors: Bryan Bishop, Walled Lake, MI (US); Stelian Borlodan, White Lake, MI (US)

(73) Assignee: Kiekert AG, Heiligenhaus (DE)

( * ) Notice: Subject to any disclaimer, the term of this patent is extended or adjusted under 35 U.S.C. 154(b) by 616 days.

(21) Appl. No.: 15/826,761

(22) Filed: Nov. 30, 2017

(65) Prior Publication Data

US 2019/0161995 A1 May 30, 2019

(51) Int. Cl.
*E05B 79/16* (2014.01)
*E05B 79/12* (2014.01)

(52) U.S. Cl.
CPC ..... *E05B 79/16* (2013.01); *E05B 79/12* (2013.01)

(58) Field of Classification Search
CPC ..... Y10T 292/57; Y10T 403/32967; Y10T 292/106; Y10T 292/0853; Y10T 403/43; Y10T 403/5706; Y10T 74/20468; E05B 79/12; E05B 83/36; E05B 79/22; E05B 85/12; E05B 79/16
See application file for complete search history.

(56) References Cited

U.S. PATENT DOCUMENTS 3,233,930 A * 2/1966 Becker ..... F16C 11/04 403/163
4,478,445 A * 10/1984 Shimizu ..... E05B 79/12 292/336.3
5,431,462 A * 7/1995 Lignell ..... E05B 79/12 292/216
10,259,350 B2 * 4/2019 Shirai ..... B60N 2/366
2007/0137403 A1 * 6/2007 Anscher ..... E05B 79/12 74/519
2008/0277948 A1 * 11/2008 Takaya ..... E05B 85/16 292/336.3
2009/0256366 A1 * 10/2009 Abe ..... E05B 79/06 292/336.3
2010/0109350 A1 * 5/2010 Gschweng ..... E05B 79/12 292/196
2010/0127516 A1 * 5/2010 Fannon ..... E05B 85/16 292/336.3
2011/0258935 A1 * 10/2011 Heller ..... B60J 5/0451 49/502
2016/0215531 A1 * 7/2016 Hirosawa ..... E05C 19/00

FOREIGN PATENT DOCUMENTS

DE 195 27 837 A1 2/1997

* cited by examiner

*Primary Examiner* — Mark A Williams
(74) *Attorney, Agent, or Firm* — Renner, Otto, Boisselle & Sklar, LLP

(57) ABSTRACT

A motor vehicle latching system with a locking mechanism 9, which comprises at least a catch and at least a pawl for ratcheting of the catch, with an operating lever 1 which can be rotated to open a motor vehicle door and with a transmission element 2 by means of which rotation of the operating lever 1 can be transmitted into pivoting of a triggering lever 3 to disengage the locking mechanism 9. For the coupling of the transmission element 2 with the operating lever 1, the transmission element 2 shiftably reaches through a coupling opening 5 of the operating lever 1. A coupling section 4 of the transmission element 2 which is located in the coupling opening 5 is arch-shaped. Especially reliable operation of the motor vehicle latching system can thus be enabled.

15 Claims, 2 Drawing Sheets

MOTOR VEHICLE DOOR LATCH

TECHNICAL FIELD OF THE INVENTION

The invention relates to a motor vehicle latching system with a locking mechanism comprising at least a catch and at least a pawl for ratcheting of the catch. The motor vehicle latching system has an operating lever which can be rotated to open a motor vehicle door and a transmission element by means of which the rotation of the operating lever can be transmitted into a pivoting of a triggering lever to disengage the locking mechanism. For the coupling of the transmission element with the operating lever, the transmission element shiftably reaches through a coupling opening of the operating lever.

BACKGROUND OF THE INVENTION

The alignment of the operating element in relation to the transmission element normally changes in the coupling area by rotation of the operating element. With the current motor vehicle latching systems, it can therefore sometimes be the case that the operating lever in the coupling area jams with the transmission element as a result of the changed alignment. This can result in malfunctions when the locking mechanism is opened.

Publication U.S. Pat. No. 4,478,445 B publishes a class-specific coupling connection with a transmission rod. A cardan system is described in DE 197 27 837 A1.

The aforementioned features known from the state of the art can be combined individually or in any combination with one of the objects and embodiments according to the invention described hereafter.

It is the object of the invention to provide a motor vehicle latching system developed further. A motor vehicle latching system according to the main claim solves the task. Advantageous embodiments result from the sub-claims.

Disclosure of the Invention

To solve this object, a motor vehicle latching system with a locking mechanism comprising at least a catch and at least a pawl to ratchet the catch is provided. The motor vehicle latching system has an operating lever that can be rotated to open a motor vehicle door. In addition, the motor vehicle latching system has a transmission element by means of which the rotation of the operating lever can be transmitted into a pivoting of a triggering lever to disengage the locking mechanism. For the coupling of the transmission element with the operating lever, the transmission element shiftably reaches through a coupling opening of the operating lever. A coupling section of the transmission element located in the coupling opening is arch-shaped.

Collision, jamming or excessively great friction of the transmission element with an internal circumference of the coupling opening can thus be prevented, namely by means of the entire rotational movement area of the operating lever which is defined and limited by a starting position and an end position. Reliable operation of the motor vehicle latching system to open the locking mechanism and prevention of functional outages can thus be attained when the locking mechanism is opened.

A transmission element which reaches through the coupling opening extends through the coupling opening in the operationally ready state. Shiftable means that the section of the transmission element which reaches through the coupling opening has a lesser transverse extension than the coupling opening. The section of the transmission element which reaches through therefore has the full extent of play compared to the coupling opening. In other words, a diameter of the section which reaches through the coupling opening is less than a diameter of the coupling opening.

Shiftable relates to a shifting in a lengthwise direction of the coupling opening. The coupling opening is a passage opening. The lengthwise direction extends from an entry of the coupling opening to an exit of the coupling opening. The lengthwise direction therefore forms a central axis of the coupling opening.

Every contour of the transmission element which can be located in a lengthwise direction at the center of the coupling opening belongs to the coupling section and every other contour does not belong to the coupling section. This applies to any random rotational position of the operating lever within its entire rotational movement area between the starting position and end position of the operating lever. A contour of the coupling section can therefore traverse the center of the coupling opening during rotation of the operating element, i.e. pass in the lengthwise direction. The center of the coupling opening corresponds to a plane transverse to the lengthwise direction which is located in the center between the entry and exit of the coupling opening.

When a motor vehicle door is closed, a locking bolt connected to the motor vehicle door goes via an inlet slot into the latch of the motor vehicle latching system and is accommodated by the catch there, which is in an opening position. The catch rotates by the movement of the locking bolt against a spring force into a closure position. In the closure position, the pawl engages into the catch in a spring-pre-tensioned manner and ratchets with the catch so that the catch can no longer rotate back into the opening position. In order to disengage the catch and to be able to open the motor vehicle door again, an external door handle or internal door handle is operated manually in order to rotate the operating lever. Alternatively or additionally, an automatic mechanism can also cause the operating lever to rotate. The triggering lever, pivoted by means of the transmission element, then acts on the pawl in particular in such a way that the pawl is disengaged from the catch, e.g. by pivoting away. The catch can thus revert to the opening position by spring force from whence the latch can leave the locking bolt again. The motor vehicle door can then be reopened. The motor vehicle door can be a lateral door, a motor flap or a trunk flap.

In one design, the coupling section extends in an arch-shaped manner within a plane. The coupling section is then flatter and/or extends only in two spatial directions which are at right angles to one another. Reduced frictional resistance can thus be attained.

In one design, the coupling section extends in three spatial directions which are at right angles to one another. The three spatial directions at right angles to one another form the three axes of a Cartesian coordinate system. The coupling section therefore extends not only in one plane, but in two planes. In particular, the extension into the second plane has a constant gradient or the coupling section is also arch-shaped. An especially reliable gliding of the coupling opening along the section of the transmission element which reaches through the coupling opening can therefore be attained. The curvature into the second plane enables a guided thrusting movement in the form of a shifting of the coupling section relatively to the coupling opening. Jamming can thus be prevented especially effectively and reliably.

In one design, the coupling section is at least partly spiral-shaped or coil-shaped and/or has the shape of a spiral-shaped or coil-shaped winding segment. In this context, a "coil-shaped coupling section" should be understood to mean a coupling section which winds in a cylinder shape with a constant gradient. In this context, cylinder-shaped winding means winding around an imaginary cylinder. A spiral-shaped or coil-shaped coupling section generally has a constant course without abrupt changes in direction. A spiral-shaped or coil-shaped coupling section or a coupling section with the shape of a spiral-shaped or coil-shaped winding segment are examples of a coupling section which extends in three spatial directions at right angles to one another. A spiral-shaped or coil-shaped winding segment has the shape of a segment cut out of a spiral or a coil.

As the coupling section is spiral-shaped or coil-shaped and/or has the shape of a spiral-shaped or coil-shaped winding segment the coupling section can be produced especially simply and at low cost by a bending operation. At the same time, an especially reliable thrust movement is enabled.

In one embodiment the coupling section is completely arch-shaped, spiral-shaped, coil-shaped and/or arch-shaped in three spatial directions at right angles to one another. The coupling section then does not comprise a straight partial section. Abrupt changes in friction between the coupling section and the internal circumference of the coupling opening, i.e. the internal shell surface of the coupling section, can thus be prevented.

In one embodiment, the coupling section is curved around an angle difference of at least 20° and/or at most 50°. The angular difference is measured between an initial tangent at a start of the coupling section and an end tangent at one end of the coupling section. The end is opposite the start. In particular, a bent lengthwise shell surface of the coupling section extends between the start and the end. An angular difference of a maximum of 50° enables especially reliable gliding of the transmission element through the coupling opening without excessive friction.

Alternatively or additionally, the coupling section extends at least by five tenths and/or by a maximum of one fifth of a circumferential arch. The proportions five tenths or one fifth relate to a proportion of a complete revolution, i.e. 360°. In particular, the rotation is related to a central axis which lies essentially vertically to a rotational axis of the operating lever and/or essentially parallel to a translational direction of the transmission lever overall on transmission of the rotation of the operating lever into a pivoting of the triggering lever. For example, a complete winding corresponds to ten tenths of a circumferential arch, i.e. 360°. The central axis is then the winding axis, in particular for a spiral-shaped or coil-shaped coupling section. The thrust movement can thus be arch-shaped and ascending at the same time. Jamming can thus be counteracted especially effectively.

In one embodiment, the arch-shaped coupling section shifts relative to the coupling opening during rotation of the operating lever. In different rotational positions of the operating lever different partial sections of the coupling section can thus in particular be located with different gradients and/or curvatures in the coupling opening. Preferably a partial section of the coupling section always corresponding to the current rotational direction of the operating lever is located in the coupling opening. The alignment of the coupling opening can also depend on the rotational position. It can thus be enabled that by the relative shifting of the coupling section to the coupling opening during rotation of the operating lever a partial section of the coupling section adjusted to the current alignment of the coupling opening is always located in the coupling opening. Jamming can thus be prevented especially effectively and friction can be reduced. A greater lifespan of the coupling connection can thus be attained. This can be implemented with an especially low manufacturing cost especially advantageously in particular by means of a spiral-shaped or coil-shaped coupling section.

The relative shifting of the coupling section to the coupling opening can result in one embodiment that on rotation of the operating lever the coupling opening performs a circular trajectory around the rotational axis of the operating direction while the coupling section overall performs a essentially translational trajectory together with the transmission element. According to the rotational position of the operating lever, the distance between the trajectory of the coupling opening and the trajectory of the transmission element or the coupling section of the transmission element thus changes. In particular, the trajectory of the coupling section runs into a translational direction and/or essentially or predominantly in a linear manner. In particular, the trajectory runs tangentially to the trajectory of the coupling opening when the operating lever is located in a central rotational position between the starting position and the end position.

The relative shifting of the coupling section to the coupling opening can result in an embodiment that on rotation of the operating lever the internal circumference or the internal shell surface of the coupling opening is pressed onto a bent or oblique section of the coupling section and thus induces a force for the relative shifting of the coupling section to the coupling opening.

The relative shifting of the coupling section to the coupling opening takes place in principle during rotation of the operating lever from the starting position into the end position and also vice versa accordingly, i.e. in both rotational directions. If the rotational direction is reversed, the direction of relative shifting is thus also reversed.

In one embodiment, a shifting/the relative shifting of the coupling section to the coupling opening is limited by one or two stops of the transmission element. Disengagement of the coupling connection between the operating lever and the transmission element can thus be particularly reliably prevented.

In one embodiment, one or two stops are formed by an area at an angle to the coupling section. One or two stops can therefore be produced especially simply. An angular area is at an angle of at least 30°. The transmission element normally has a turning area to execute the angular deflection if the angular area has been produced by a turning process. If the part of the transmission element reaching through the coupling opening is rod-shaped, the turning area is therefore inevitable for manufacturing reasons and is kept as small as possible. For example, this can be achieved by clamping of the transmission element, e.g. an operating rod and turning on one edge. A turning area is curve-shaped in principle and/or generally produces an abrupt change in direction. A curve-shaped turning area as a transition to an angular area in principle constitutes an abrupt change in direction compared to the constant, uniform course of the coupling section.

In one design, the one or two stops are respectively formed by a turning area. The angular area or the angular areas therefore act as a stop or stops in attaining loss security in the case of unscheduled movement processes, e.g. in the event of a crash.

In one embodiment, the transmission element encompasses two stops and the coupling section and/or the coupling opening are located between the two stops. Disengagement of the transmission element from the coupling opening can thus be prevented especially effectively.

In one embodiment, the two stops are distanced from one another in such a way that the relative shifting of the coupling section to the coupling opening can occur over a section length as a maximum which corresponds to at least 30% and/or a maximum of 50% of a length of the coupling opening. The length of the coupling opening must be measured in a lengthwise direction of the coupling opening. A reliable relative shifting in both directions according to the direction of the rotational direction of the operating lever can thus be enabled.

In one embodiment, the coupling opening is provided by a component which is firmly connected to the operating lever, in particular by a sleeve. By provision of the coupling opening by a component which is firmly connected to the operating lever, i.e. a separate component, an especially hard material can be selected to provide the internal circumference or the internal shell surface of the coupling opening while a cost-effective material, such as steel metal or plastic, is simultaneously used for the operating lever. An especially high-quality surface of the internal circumference or the internal shell surface of the coupling opening with especially low friction and wear can thus be enabled in an operating lever which can otherwise be produced at low cost. In particular, the especially simple use of a component, e.g. by use of a sleeve, permits the provision of a coupling opening which is longer than a thickness of the operating lever. The firm connection is preferably due to form fitting.

In one embodiment, the coupling section is at least partly rod-shaped. The section of the transmission element with the coupling section reaching through the coupling opening can thus be produced at especially low cost, in particular only due to relevant bending and turning.

In one embodiment, the transmission element is rod-shaped overall. An operating rod can thus be used as an entire transmission element. Manufacturing costs can therefore be reduced.

In one embodiment, the transmission element overall performs a translational movement into a translational direction in order to transmit the rotation of the operating lever into a pivoting of the triggering lever to disengage the locking mechanism. The relative shifting of the coupling section to the coupling opening can thus occur dependent on the rotational movement of the operating lever. In particular, the transmission element overall performs a linear translational movement into the translational direction which is essentially or predominantly linear on rotation of the operating lever. The expression "overall" or "transmission element overall" means the entire element or transmission element and not simply a part or a section thereof. If the transmission element performs a translational movement into a translational direction overall, the translational movement proportion outweighs in particular an essentially linear movement proportion into the translational direction compared to a rotational movement proportion.

Exemplary embodiments of the invention are explained in further detail hereafter on basis of the following figures. Features of the exemplary embodiments and alternative or complementary designs described hereafter can be combined with the stressed objects individually or in combination. The stressed protected areas are not restricted to the exemplary embodiments.

DETAILED DESCRIPTION OF A VARIANT OF THE INVENTION

Figure 1:
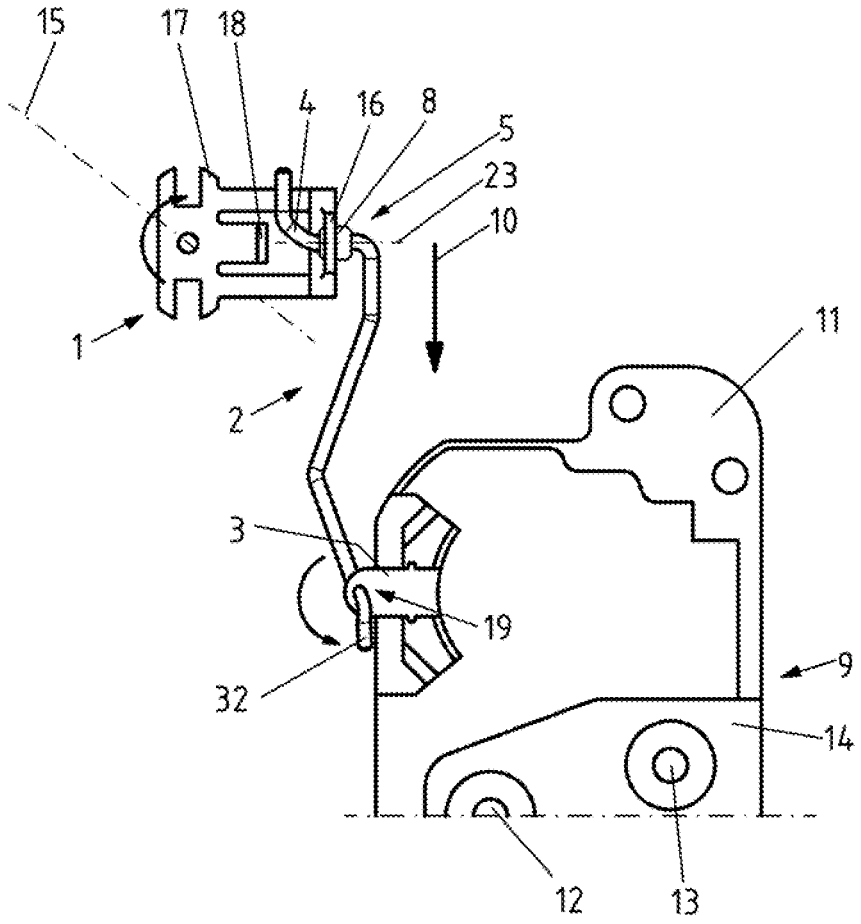
FIG. 1: Diagram of a motor vehicle latching system during transmission of the rotation of an operating lever into pivoting of a triggering lever by a transmission element.

FIG. 1 shows a motor vehicle latching system with a locking mechanism 9, which encompasses a catch and a pawl for ratcheting of the catch, and with an operating lever 1 which can be rotated to open a motor vehicle door from a starting position into an end position. FIG. 1 shows an opening process in which the operating lever 1 has been set into motion, specifically into a clockwise rotation around a rotational axis 15, via manual operation of an external operating lever (not depicted in the Figures). FIG. 1 shows motor vehicle latching system at a time during operation when the operating lever 1 is already located approximately halfway between the starting position and the end position. In particular, a protrusion 18 of the connection acts with the external operating lever or a return spring. The operating lever 1 is preferably illustrated as depicted in FIG. 1 due to installation space, i.e. a lengthwise end 16 is at an angle of 30° to 90° to a basic part 17 rotatably accommodated around the rotational axis 15.

The motor vehicle latching system comprises a transmission element 2 in form of an operating rod. The rotation of the operating lever 1 is transformed into a translational movement of the transmission element 2 by means of a coupling connection. If the operating lever 1 rotates in the clockwise direction, the transmission element 2 moves in a translational direction 10 predominantly in a linear manner in the direction of a triggering lever 3. Due to a further coupling connection 19 with the triggering lever 3 the translational movement is transformed into a pivoting of the triggering lever 3 in turn.

If the operating lever 1 rotates in the clockwise direction, the triggering lever 3 is pivoted in an anti-clockwise direction. In one design, the pivoting of the triggering lever 3 in an anti-clockwise direction leads to the disengagement of the locking mechanism 9. The locking mechanism 9 is arranged in the latch housing 11 together with the pawl and the catch. The catch rotational axis 12 and the pawl rotational axis 13, in particular in the form of a pin or a bolt are attached to the metal latch plate 14 and are externally visible, as shown in FIG. 1. The latch plate 14 which also has an inlet slot for a locking bolt (not included in the excerpt from FIG. 1), borders the plastic latch housing 11 and is firmly connected thereto. In order to disengage the locking mechanism, the triggering lever 3 can act on the pawl within the latch housing 11 in order to release the pawl from the catch if the catch is located in a closure position.

In order to form the coupling connection of the transmission element 2 with the operating lever 1 the transmission element 2 shiftably reaches through a coupling opening 5 of the operating lever 1. A coupling section 4 of the transmission element 2, shown in FIGS. 2 and 3 and found in the coupling opening 5, is arched. The coupling opening 5 is provided by a separate sleeve 8 which is firmly connected to the lengthwise end 16. The sleeve 8 extends through a passage opening of the lengthwise end 16 and lines this internally. The sleeve 8 is in particular at least twice as long as the passage opening. The length of the passage opening corresponds to the thickness of the operating lever, i.e. in particular the sheet thickness.

Figure 2:
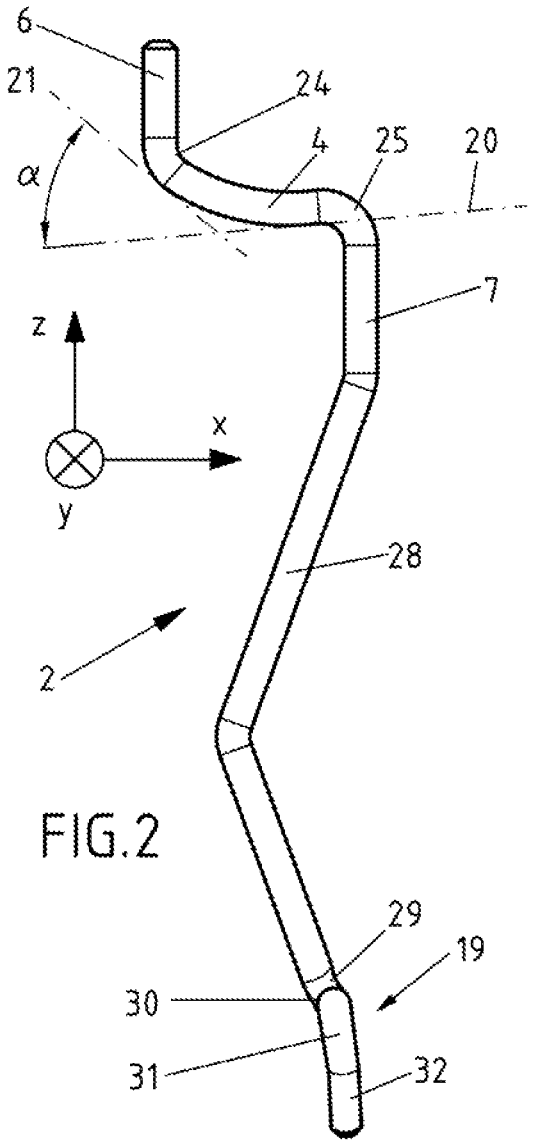
FIG. 2: Diagram of the transmission element of FIG. 1 in a lateral view.

FIG. 2 shows the transmission element 2 of FIG. 1 embodied as an operating rod in a lateral view. The viewing direction is shown in the direction of a y-axis. The z-axis and x-axis form a Cartesian coordinate system together with the y-axis. The coupling section 4 is arched around an angular difference $\alpha$ which is less than 50° in FIG. 2. The angular difference $\alpha$ of the arch is measured between an initial tangent 20 at a start of the coupling section 4 and an end tangent 21 at one end of the coupling section 4.

The coupling section 4 lies between a first stop 6 and a second stop 7 which define the part 22 of the transmission element 2 reaching through the coupling opening 5 to form the coupling connection and a relative shifting of this part 22 to the coupling opening 5 limit in the lengthwise direction 23 of the coupling opening 5. In particular, the lengthwise direction 23 and the rotational axis 15 are situated in a plane and/or include an angle between 20° and 90°. If the operating lever is located in a rotational position approximately halfway between the starting position and the end position, the translational direction 10 and the lengthwise direction 23 of the coupling opening 5 are located approximately vertically to one another. In particular, the alignment changes, i.e. the included angle, the lengthwise direction 23 of the coupling opening 5 relatively to the translational direction 10 with rotation of the operating lever 1 between the central rotational position and any malpositioning of the operating lever 1. An approximately central rotational position is shown in FIG. 1.

As the first stop 6 and the second stop 7 were produced by turning of the rod-shaped transmission element 2, a first turning area 24 is located between the coupling section 4 and the first stop 6 and/or a second turning area 25 is located between the coupling section 4 and the second stop 7. In particular, the first stop 6 and/or the second stop 7 are straight sections of the rod-shaped transmission element 2. The stop 6 preferably forms the end of the transmission element.

Figure 3:
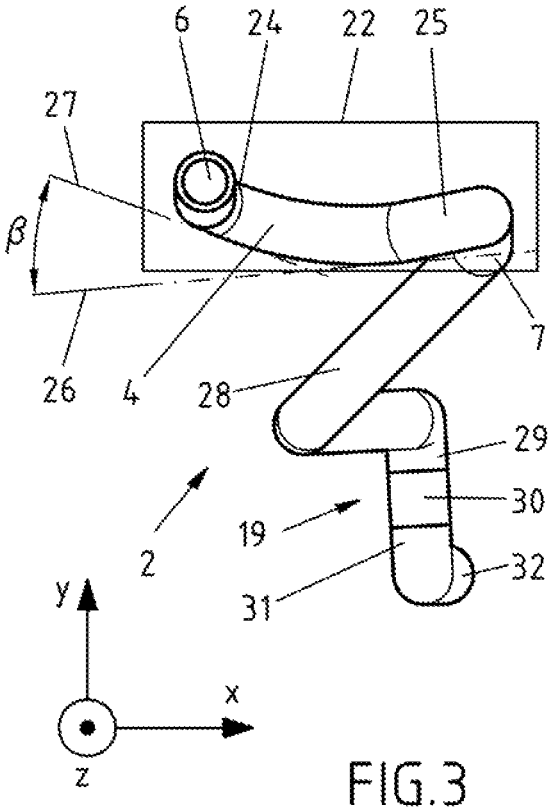
FIG. 3: Diagram of the transmission element of FIGS. 1 and 2 in a top view.

FIG. 3 shows the transmission element 2 of FIG. 2 executed as an operating rod in a top view. The viewing direction points in the direction of the z-axis. The coupling section 4 is arched around an angular difference $\beta$ which is less than 50° in FIG. 3. The angular difference $\beta$ of the arch is measured between the initial tangent 26 at a start of the coupling section 4 and an end tangent 27 at one end of the coupling section 4. If the coupling section 4 is a coiled section, the angular difference can also be a gradient according to the alignment of the Cartesian coordinate axes x, y, z.

The coupling section 4 shown in the exemplary embodiment of FIGS. 2 and 3 is coil-shaped and has the shape of a coil segment. The coil segment winds around a central axis or winding axis which runs approximately parallel to the translational direction 10. In particular, the coupling section 4 extends in the form of the coil segment by less than one fifth of a circumferential arch around the central axis or winding axis.

The part 22 is connected to the part for further coupling connection 19 with the triggering lever 3 by a connecting section 28. In particular, the connecting section 28 has a V-shape sweeping in a translational direction 10, i.e. a flat angle in order to attain a mechanically advantageous alignment in view of the rotation of the operating lever 1 on the one hand and pivoting of the triggering lever 3 on the other hand.

The further coupling connection 19 on the transmission element 2 is formed by a turning area 29, which is adjacent to the connecting section 28 in particular, a coupling area 30 extending in a linear manner, a further turning area 31 and/or an end area 32. The aforementioned areas 28 to 32 are preferably directly adjacent to one another in the stated sequence. The end area 32 preferably forms the end of the transmission element 2 opposite the first stop 6. The coupling area 30 is located in a passage opening 33 of the triggering lever 3.

When the operating lever 1 rotates, relative shifting of the coupling section 4 or the entire part 22 occurs relatively to the coupling opening 4. Starting from the approximate central position of the operating lever 1 shown in FIG. 1 and with continued rotation in a clockwise direction, the coupling opening 5 or the sleeve 8 moves in particular in the direction of the first stop 6. In one design, the lengthwise end 16 or an external edge of the sleeve 8 impacts in a lengthwise direction 23 against the first stop 6 and/or the first turning area 24 on attainment of the end position of the operating lever 1. It can be that the first stop 6 is not directly touched and thus acts as a stop in the case of misuse, wear, deformation, excess load or in the case of a crash.

Starting from the approximate central position of the operating lever 1 shown in FIG. 1 and with rotation in an anti-clockwise direction back into the starting position, the coupling opening 5 or the sleeve 8 moves in particular in the direction of the second stop 6. In one design, the lengthwise end 16 or an external edge of the sleeve 8 impacts in a lengthwise direction 23 against the second stop 7 and/or the second turning area 25 on attainment of the end position of the operating lever 1. It can be that the second stop 7 is not directly touched and thus acts as a stop in the case of misuse, wear, deformation, excess load or in the case of a crash.

By relative shifting in conjunction with the bent shape of the coupling section 4, in particular in the design of a coil section, a thrust movement is assisted by the coupling section 4 so that the changing alignment of the coupling opening 5 is caught by the coupling section 4 or the partial section of the coupling section 4 surrounded by the coupling opening 5.

Figure 4:
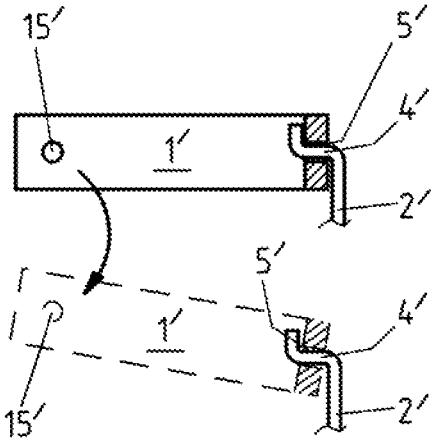
FIG. 4: Diagram of a coupling connection according to the state of the art.

FIG. 4 shows a diagram of a coupling connection according to the state of the art; An operating lever 1' rotating around the rotational axis 15' has a coupling opening 5' in the form of a passage opening. FIG. 4 shows a sectional view through the passage opening.

A straight coupling area 4' of a transmission element 2' is surrounded by the coupling opening 5'. If the operating lever 1' is rotated around the rotational axis 15' (depicted in dot dashes), there is a risk of catching or jamming of the transmission element 2'.

The invention claimed is:

1. A motor vehicle latching system comprising:

a locking mechanism having at least a catch and at least a pawl provided for ratcheting of the catch, a triggering lever that is pivoted to engage the pawl to disengage the pawl from the catch during an opening operation of the locking mechanism, an operating lever which is rotated during opening of a motor vehicle door, and a transmission element for transmitting rotation of the operating lever into pivoting of the triggering lever for engaging the pawl, wherein the transmission element extends through a coupling opening of the operating lever to couple the transmission element with the operating lever, wherein a coupling section of the transmission element is supported in the coupling opening and the coupling section is arch-shaped along an entire length of the coupling section, the coupling section having a diameter that is less than a diameter of the coupling opening so as to allow for a full extent of play of movement of the coupling section within the coupling opening, whereby the coupling section is received in the opening and, during operational use of the locking mechanism, the coupling section is shiftable in a lengthwise direction of the coupling opening, wherein the arch-shaped coupling section glides along the coupling opening, and the coupling section is at least partly spiral-shaped or coil-shaped as a winding segment.

2. The motor vehicle latching system of claim 1, wherein the majority or the entire coupling section has the shape of a spiral-shaped or coil-shaped winding segment.

3. The motor vehicle latching system of claim 1, wherein the coupling section is arched around an angular difference ($\alpha$, $\beta$) of a maximum of 50° and/or of a maximum of one fifth of a circumferential arch.

4. The motor vehicle latching system of claim 1, wherein during rotation of the operating lever, the arch-shaped coupling section is shifted relatively to the coupling opening.

5. The motor vehicle latching system of claim 1, wherein a relative shifting of the coupling section to the coupling opening is limited by at least one stop of the transmission element.

6. The motor vehicle latching system of claim 5, wherein one or two stops are formed by an area at an angle to the coupling section.

7. The motor vehicle latching system of claim 5, wherein two stops are provided that are at a distance from one another whereby the relative shifting of the coupling section to the coupling opening can occur over a section length as a maximum which corresponds to at least 30% and/or a maximum of 50% of a length of the coupling opening.

8. The motor vehicle latching system of claim 1, wherein the coupling opening is provided by a component firmly connected to the operating lever.

9. The motor vehicle latching system of claim 1, wherein the transmission element performs a translational movement into a translational direction in order to transmit the rotation of the operating lever into pivoting of the triggering lever to engage the pawl.

10. The motor vehicle latching system of claim 8, wherein the component is a sleeve.

11. The motor vehicle latching system of claim 1, wherein the transmission element includes two stop portions engageable against the coupling opening, wherein the coupling section extends between the two stop portions and shifting of the coupling section is limited by the two stop portions.

12. The motor vehicle latching system of claim 11, wherein the transmission element includes a first turning area arranged between a first stop portion and the coupling section and a second turning area arranged between a second stop portion and the coupling section, wherein the transmission element has angular deflection in the first turning area and in the second turning area.

13. The motor vehicle latching system of claim 11, wherein the first stop portion forms an end of the transmission element.

14. The motor vehicle latching system of claim 11, wherein the two stop portions are straight, the coupling section being curved between the two stop portions.

15. The motor vehicle latching system of claim 14, wherein a curvature of the coupling section between the two stop portions is smooth without a sharp corner.

* * * * *